US005510003A

United States Patent [19]

Colasurdo et al.

[11] Patent Number: 5,510,003

[45] Date of Patent: Apr. 23, 1996

[54] METHOD OF SIZING AND AQUEOUS SIZING DISPERSION

[75] Inventors: Anthony R. Colasurdo, Marietta, Ga.; Ian R. Hiskens; Nicholas S. Morgan, both of Bristol, England; Karen J. Smith, Woodstock, Ga.

[73] Assignee: Eka Nobel AB, Bohus, Sweden

[21] Appl. No.: 277,851

[22] Filed: Jul. 20, 1994

[51] Int. Cl.[6] ..... D21H 21/16

[52] U.S. Cl. ..... 162/158; 162/179; 162/180; 162/181.2; 106/218; 106/238; 106/287.2; 106/287.23; 106/287.24

[58] Field of Search ..... 162/158, 180, 162/179, 181.2; 106/218, 238, 287.2, 287.23, 287.24

[56] References Cited

U.S. PATENT DOCUMENTS

| | | | |
|---|---|---|---|
| 3,887,427 | 6/1975 | Helmer et al. | 162/158 |
| 4,540,635 | 9/1985 | Ronge et al. | 428/498 |
| 4,743,303 | 5/1988 | Helmer et al. | 106/236 |
| 4,816,073 | 3/1989 | Helmer et al. | 106/238 |
| 4,842,691 | 6/1989 | Nakajima et al. | 162/158 |
| 5,201,944 | 4/1993 | Nakata et al. | 106/144 |

FOREIGN PATENT DOCUMENTS

| | | | |
|---|---|---|---|
| 0074544 | 3/1983 | European Pat. Off. | D21H 3/02 |
| 275851 | 7/1988 | European Pat. Off. | 162/180 |
| 0292975 | 11/1988 | European Pat. Off. | D21D 3/00 |
| 0333368 | 9/1989 | European Pat. Off. | D21D 3/00 |
| 0453991A1 | 10/1991 | European Pat. Off. | D21H 17/34 |
| 0537682 | 4/1993 | European Pat. Off. | D21H 17/62 |
| 0580405 | 1/1994 | European Pat. Off. | D21J 21/16 |
| 53-35006 | 4/1978 | Japan | D21D 3/00 |

OTHER PUBLICATIONS

Novak, R. W. and Rende, D. S., *Tappi J.*, vol. 76, No. 8, p. 117 (1993).

Colasurdo, A. R. and Thorn, I., *Tappi Journal*, (1992), "Papermakers Conference Proceedings", Tappi Press, Atlanta, p. 135.

*Primary Examiner*—Peter Chin

*Attorney, Agent, or Firm*—Ralph J. Mancini; Louis A. Morris

[57] ABSTRACT

The invention relates to a method of sizing paper and similar cellulose products containing precipitated calcium carbonate as a filler. According to the method, an aqueous suspension of pulp is dewatered and dried in the presence of an aqueous dispersion of a rosin-based sizing agent, which comprises a rosin component and a rosin ester component, and an aqueous dispersion of a cellulose-reactive sizing agent. The invention also relates to an aqueous dispersion of sizing agents which comprises a rosin-based sizing agent, which contains a rosin component and a rosin ester component, and a cellulose-reactive sizing agent.

20 Claims, No Drawings

METHOD OF SIZING AND AQUEOUS SIZING DISPERSION

FIELD OF THE INVENTION

This invention relates to a method of sizing paper and similar cellulose products containing precipitated calcium carbonate as a filler and to an aqueous sizing dispersion.

BACKGROUND OF THE INVENTION

Precipitated calcium carbonate (PCC) is used extensively as a filler in alkaline paper due to its low cost and ability to impart opacity, brightness and bulk. The development of internal sizing agents that are effective at neutral and alkaline pH values has made it possible to produce internally sized PCC filled paper, and the sizing agents widely used for this purpose are alkyl ketene dimer (AKD) and alkenyl succinic anhydride (ASA). These sizing agents react with the cellulosic hydroxyl groups and they generally give a high initial sizing response at small added amounts. However, in recent years it has been experienced that the sizing response initially obtained with AKD or ASA is not maintained over time. This phenomena has been referred to as size reversion, i.e., the sized paper is within specification at the reel, but, upon ageing, the sizing response decreases to a level where it then remains constant. In addition, there have been examples of in specification sizing to result in a complete loss of sizing with time, termed fugitivity. The practical consequences of size reversion and fugitivity in PCC filled paper have been seen in terms of poor economics, converting and end-use problems.

In order to counter size reversion, the papermaker has had to increase the level of sizing agent added internally or, additionally, add a surface sizing agent. Although this has often resulted in retarding of sizing deterioration, the increased level of sizing agent used has been found to cause conversion and end-use problems. For example, increased levels of AKD has resulted in slippage problems and poor toner adhesion. During converting of certain grades of fine paper, for example Forms Bond, envelope, adding machine tape and some cut-size grades, precise control is necessary during high speed handling. Here, paper slippage has resulted in, for example, dropped folds, perforation misregister and reduced press speed.

The use of rosin dispersions for internal or stock sizing is well-known in the art. The rosin material is fixed to the cellulose fibers by precipitation with aluminum compounds. However, in order to be effective, sizing with rosin dispersions should be carried out at acidic pH values between 4 and 6. When the stock has a neutral or alkaline pH, sizing with rosin becomes erratic and very difficult to control. In addition, carbonate fillers present in the stock may interact with the components of the sizing system and adversely affect the sizing efficiency. Thus, the impact of alkalinity and calcium carbonate on aluminum and rosin chemistries has hitherto rendered it economically as well as technically disadvantageous to apply rosin dispersions to papermaking systems including PCC as a filler.

It is further known in the art to combine rosin and cellulose-reactive sizing agents in order to obtain a more widely useful sizing agent. EP-A1-74 544 discloses a method of sizing using cationic dispersions of dispersed particles of a cellulose-reactive sizing agent and dispersed particles of fortified rosin. U.S. Pat. No. 4,743,303 discloses a method of sizing employing anionic and cationic dispersions in which the dispersed particles contain a mixture of a cellulose-reactive sizing agent and rosin material in the form of rosin and fortified rosin. U.S. Pat. No. 4,816,073 discloses a method of sizing utilizing the above anionic and cationic dispersions which further contain a polyaluminum compound. EP-A2-333 368 discloses a paper sizing process in which a pre-blended composition containing rosin, optionally extended with an AKD emulsion, and an aluminum compound is added to papermaking stock containing chalk. However, none of the above publications mention sizing in the presence of PCC and there is no indication that there is a particular problem caused by including PCC as a filler in sized paper.

It is an object of this invention to provide a method of sizing which reduces or eliminates the problems associated with size reversion and fugitivity in sized paper and similar cellulose products containing precipitated calcium carbonate as a filler. It is a further object of this invention to provide an aqueous dispersion of sizing agents which can be used to effect sizing according to the method of the invention.

The objects of the invention are achieved by a method of sizing and an aqueous dispersion of sizing agents as further defined in the claims.

SUMMARY OF THE INVENTION

The present invention relates to a method of sizing cellulose based products containing precipitated calcium carbonate as a filler paper such as, paper board, board and the like, wherein an aqueous suspension of pulp used in preparing said cellulose based products is dewatered and dried in the presence of an aqueous dispersion of a rosin-based sizing agent, which comprises a rosin component and a rosin ester component, and an aqueous dispersion of a cellulose-reactive sizing agent.

DETAILED DESCRIPTION OF THE INVENTION

The present invention generally relates to a method of sizing cellulose fiber based products containing precipitated calcium carbonate as a filler. The process comprises dewatering and drying an aqueous suspension of pulp used in preparing said cellulose products in the presence of an aqueous dispersion of a rosin-based sizing agent, which comprises a rosin component and from 5 to 75% by weight based on the rosin-based sizing agent of a rosin ester component, and an aqueous dispersion of a cellulose-reactive sizing agent, wherein the weight ratio of rosin-based sizing agent to cellulose-reactive sizing agent is from 1:1 to 20:1.

According to the present invention, it has been found that it is possible to overcome the problems and limitations of size reversion and fugitivity in PCC-containing sized paper if sizing is effected by means of a rosin-based sizing agent comprising a rosin component and a rosin ester component in combination with a cellulose-reactive sizing agent. According to the present invention, it is not only possible to achieve a very good initial sizing response, but also the sizing response can be maintained at a higher level than is achievable with prior art sizing methods. According to the present invention, it has also been found that the initially good sizing response can be further improved at storage of the paper produced. The advantageous effect of utilizing a rosin-based sizing agent in combination with a cellulose-reactive sizing agent is unexpected, since it is well-known in the art that rosin dispersions are preferably used for acidic sizing but not for alkaline sizing, in particular not for alkaline sizing when calcium carbonate and especially PCC is contained in the stock as a filler.

Various types of powdered calcium carbonates are used in the manufacture of paper such as chalk, ground limestone and precipitated calcium carbonate. Whereas chalk and other ground carbonates are produced by the mechanical treatment, such as crushing and grinding, of naturally occurring materials, precipitated calcium carbonate is a different material produced synthetically in a chemical precipitation process, usually the carbonation process, where calcium hydroxide is converted to calcium carbonate by reaction with carbon dioxide. The reaction conditions determine the type of crystals, the size of particles and the size distribution produced. Compared to dry or wet ground carbonates, the commercially available precipitated calcium carbonates are distinguished by a finer particle size, a narrower particle size distribution, and a higher specific surface area.

It is known in the art that a finer particle size and a higher specific surface area create more demand for size, thus making PCC-containing pulp slurries more difficult to size than pulp slurries containing ground carbonates. In addition, it has been shown that PCC fillers produce higher pH values than other calcium carbonate fillers, both in the stock and in the paper produced. Whereas the problems associated with size reversion and fugitivity have been experienced in applications including PCC fillers, in particular with scalenahedral PCC, these drawbacks have not been observed to any degree in applications using other alkaline mineral fillers.

According to the present invention, the stock can contain PCC having any one or mixtures of the various crystalline forms or morphologies that exists, including calcite of rhombohedral, prismatic, tabular, cuboid and scalenohedral forms and aragonite of acicular form. Scalenohedral and rhombohedral PCC's are preferably used. The PCC can have an average particle size ranging from about 0.02 μm to about 7 μm and a specific surface area ranging from about 2 to about 20 $m^2/g$.

The stock to be dewatered and dried according to the present invention can contain PCC in an amount up to about 35% by weight, suitably from 5 to 30% by weight and preferably from 10 to 25% by weight, counted as dry on dry cellulose fibers. In addition to PCC, the stock can contain further fillers such as any of those known in the art, including e.g., chalk, limestone, ground calcium carbonate, kaolin (china clay), talc, titanium dioxide, bentonite, wollastonite, glass fibers, expanded perlite, etc., wherein the total amount of fillers contained in the stock can be up to about 35% by weight and suitably from 5 to 30% by weight, counted as dry on dry cellulose fibers. The use of PCC as a filler according to the invention may produce a stock pH ranging from about 7 to about 10, and in particular between 7.5 and 9.

According to the method of the invention, an aqueous dispersion of sizing agents can be added to the stock. For reasons of simplicity and convenience, the invention will be described in terms of the present dispersion, it being understood that features of the dispersion are also applicable to the present method employing said dispersion. Thus, the present invention further relates to an aqueous dispersion of sizing agents, said dispersion comprises a rosin-based sizing agent, which contains a rosin component and a rosin ester component, and a cellulose-reactive sizing agent.

The term rosin used herein refers to rosin which can be derived from customary rosins, e.g., from gum rosin, tall oil rosin, wood rosin or mixtures thereof, in their crude or refined state. The rosin component present in the rosin-based sizing agent can be selected from rosin, modified rosin, fortified rosin, and mixtures thereof. Modified rosin is rosin which has been modified in a known manner, such as for example disproportionated rosin, hydrogenated rosin, polymerized rosin, formaldehyde-treated rosin, etc. Preferably, the rosin component is a fortified rosin, i.e., a Dieis-Alder adduct obtained in a known manner by the reaction between rosin, optionally modified as above, and an α, β-unsaturated carbonyl compound, e.g., maleic acid, fumaric acid, itaconic acid, citraconic acid or their available anhydrides or half esters, acrylic acid and methacrylic acid. The fortified rosin can of course be prepared from mixtures of α,β-unsaturated carbonyl compounds, e.g., those mentioned above, and mixtures of different fortified rosins can also be used. Fortified rosin generally contain up to about 15% by weight of adducted α,β-unsaturated carbonyl compound, suitably from 3 to 12% by weight, based on the total weight of the fortified rosin.

The amount of rosin component present in the rosin-based sizing agent is preferably in the range of from about 25% to about 95% by weight, based on the total amount of rosin-based sizing agent. Preferably, the rosin component is present in an amount of from about 35% to 90% by weight, and more preferably from about 45% to 85% by weight based on the total amount of rosin-based sizing agent.

An essential feature of the present invention is that the rosin-based sizing agent contains a rosin ester component. The rosin ester component can be a rosin ester of an alcohol selected from mono-, di-, and polyhydric alcohols, and mixtures thereof. The rosin ester can be prepared in a conventional manner by esterification of rosin, optionally modified as above, with a mono-, di-, or polyhydric alcohol or mixtures thereof to form an ester or part ester. Esterification processes are described for example in U.S. Pat No. 4,842,691 to which reference is made. The mono-, di- and polyhydric alcohols suitably have up to 30 carbon atoms. As examples of suitable monohydric alcohols can be mentioned cyclic, branched and straight chain alkyl alcohols having from 5 to 25 carbon atoms, preferably long-chain hydrophobing alkyl alcohols. Specific examples thereof include octyl, decyl, dodecyl, tetradecyl, hexadecyl, octadecyl, eicosyl and docosyl alcohols. Use is preferably made of a rosin ester of an alcohol selected from di- and polyhydric alcohols such as tri- and tetrahydric alcohols. Such alcohols can be selected from glycols such as ethylene glycol, diethylene glycol, triethylene glycol and polyethylene glycols, trimethylene glycol, glycerol, diglycerol, trimethylol ethane, trimethylol propane, pentaerythritol, dipentaerythritol, alkanol amines such as triethanolamine, tripropanolamine, triisopropanolamine, and mixtures thereof. The rosin ester component can contain a fortified rosin ester where the esterification may have been carried out before or after the fortification.

The rosin ester component may be extended with a further ester compound, such as fatty acid esters prepared from fatty acids and alcohols selected from mono-, di-, and polyhydric alcohols, such as those defined above. Suitably, the fatty acid contains more than 8 carbon atoms and can be any of the organic acids defined below. The amount of extending fatty acid ester is suitably less than 50% by weight, preferably from 10 to 30% by weight, based on the rosin ester component.

The rosin ester component may contain a mixed rosin-fatty acid ester of an alcohol selected from di- and polyhydric alcohols, such as those defined above. Suitable fatty acids are those mentioned above. The mixed esters can be prepared by coreacting rosin and the fatty acid with the alcohol in a conventional manner. The mixed ester can contain rosin and fatty acid in any proportion and suitably the rosin content is from 25 to 75% by weight, based on the amount of rosin and fatty acid in the mixed ester.

The amount of rosin ester component present in the rosin-based sizing agent component can be from 5 to 75% by weight, based on the total amount of rosin-based sizing agent. Preferably, the rosin ester is present in an amount of from 10 to 65% by weight, and most preferably from 15 to 55% by weight, based on the total amount of rosin-based sizing agent.

The cellulose-reactive sizing agent according to the invention can be a cellulose-reactive sizing agent selected from the group consisting of ketene dimers, acid anhydrides, organic isocyanates, carbamoyl chlorides and mixtures thereof, preferably ketene dimers and acid anhydrides. Any of the cellulose-reactive sizing agents known in the art may be used. Suitable ketene dimers have the formula

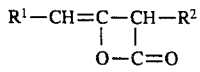

in which $R^1$ and $R^2$ represent hydrocarbon groups, usually alkyl having at least 8 carbon atoms, or cycloalkyl having at least 5 carbon atoms, aryl, aralkyl and alkaryl. Examples of suitable ketene dimers include octyl, decyl, dodecyl, tetradecyl, hexadecyl, octadecyl, eicosyl, docosyl, tetracosyl, phenyl, benzyl, β-naphthyl and cyclohexy ketene dimers, and the ketene dimers prepared by known methods from organic acids such as montanic acid, naphthenic acid, $\Delta^{9,10}$-decylenic acid, $\Delta^{9,10}$-dodecylenic acid, palmitoleic acid, oleic acid, ricinoleic acid, linoleic acid, and eleostearic acid, and from naturally occurring mixtures of fatty acids, such as those found in coconut oil, babassu oil, palm kernel oil, palm oil, olive oil, peanut oil, rape oil, beef tallow, lard and whale blubber. Mixtures of any of the above ketene dimers can also be used.

Suitable acid anhydrides can be characterized by the general formula

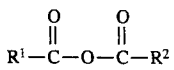

in which $R_1$ and $R_2$ can be identical or different and represent saturated or unsaturated hydrocarbon groups having from 8 to 36 carbon atoms, which can be straight or branched chain alkyl, aralkyl or alkaryl, or $R^1$ and $R^2$ can together with the -C-O-C- moiety form a 5 to 6 membered ring, which can be further substituted with alkyl, alkenyl, aralkyl and alkaryl. Examples of suitable acid anhydrides include myristoyl, palmitoyl, oleoyl, and stearoyl anhydrides, substituted succinic acid anhydrides such as isooctadecenyl, n-hexadecenyl, dodecyl, decenyl and octenyl succinic acid anhydrides, and substituted glutaric acid anhydrides such as heptyl glutaric acid anhydride.

Examples of suitable carbamoyl chlorides include those disclosed in U.S. Pat. No. 3,887,427, which is incorporated herein by reference.

The weight ratio of rosin-based sizing agent to cellulose-reactive sizing agent can be within the range of from 1:1 to 20:1, suitably from 2:1 to 15:1 and preferably from 3:1 to 10:1. Most preferably, the weight ratio is from 4:1 to 7:1.

The particles of the dispersions according to the invention comprises the two active sizing agents, i.e., rosin-based sizing agent and cellulose-reactive sizing agent. Minor amounts of inert substances can of course also be present, e.g., production auxiliary substances such as hydrocarbons, paraffins, waxes. The amount of such substances should, how-ever, preferably not exceed 25% by weight, based on the active sizing agents. The total amount of active sizing agents in the present dispersions can be within the range from 5 to 70% by weight and suitably within the range from 10 to 50% by weight.

The dispersion according to the invention can be prepared using one or several dispersing agents selected from the groups anionic and cationic dispersing agents. It is preferred that the dispersion is anionic. The amount of dispersing agent should be sufficient to confer the desired charge and storage stability to the dispersion, and it should usually be at least 2% by weight, based on the amount of sizing agents. Normally, it is seldom necessary to use more than 5% by weight.

The requirements on the dispersing agents are that they give the desired net charge and that they do not have a negative influence on the sizing effect of the dispersions. The dispersing agents can be any of those conventionally employed at preparation of aqueous sizing dispersions or emulsions. Anionic dispersing agents can for example be selected from saponified rosin derivatives, alkyl sulphates, alkylaryl sulphates, alkyl sulphonates, alkylaryl sulphonates etc. Particularly suitable anionic dispersing agents are alkyl sulphates and alkyl sulphonates, e.g., sodium lauryl sulphate. Cationic dispersing agents can for example be selected from nitrogen-containing dispersing agents such as quaternary ammonium compounds, salts of tertiary amines, cationic starches, water-soluble polyaminopolyamide/epichlorohydrin resins, water-soluble alkylenepolyamine/epichlorohydrin resins, poly(diallylamine)/epichlorohydrin resins, etc. Particularly suitable cationic dispersing agents are quaternary ammonium compounds. The present dispersion can also contain protective colloids, such as any of those known in the art, e.g., polyvinyl alcohol, cationic starch, casein, and cellulose derivatives. To obtain a more stable dispersion, it can also be advantageous to include nonionic or amphoteric surface active agents in the dispersion.

The dispersion according to the invention can contain dispersed particles of rosin-based sizing agent and dispersed particles of cellulose-reactive sizing agent, or dispersed particles containing a mixture of rosin-based sizing agent and cellulose-reactive sizing agent, or a combination of the mentioned dispersed particles. Dispersions containing discrete particles of rosin-based sizing agent and cellulose-reactive sizing agent can be prepared by mixing a preformed dispersion of rosin-based sizing agent with a preformed dispersion of cellulose-reactive sizing agent. Such dispersions according to the invention are preferably prepared by mixing either preformed anionic sizing dispersions or preformed cationic sizing dispersions. However, they can also be prepared by mixing preformed sizing dispersions of opposite charge, as long as the resulting inventive dispersion shows the desirable charge and storage stability.

Aqueous dispersions of rosin-based sizing agents are commercially available and can be prepared in per se conventional manner, e.g., by homogenizing the active substance in water in the presence of a dispersing agent using high shear forces and fairly high temperatures so that fine particles, generally with a size below about 1.0 μm, are obtained as the dispersed phase. The active substance which is homogenized is a rosin component, rosin ester component or, preferably, a homogenous mixture thereof. The homogenous mixture is preferably prepared by intensive mixing of melted rosin component and rosin ester component. However, it is also possible to obtain a homogenous mixture starting from solutions of the respective components in solvents. The active substance is dispersed in water in the presence of a dispersing agent under satisfactory agitation, for example by use of a static mixer or an Ultra Turrax equipment. The warm dispersed phase is then homogenized and cooled. Alternatively, the dispersion of the rosin-based sizing agent can be prepared by the inversion process, i.e., an aqueous solution of a dispersing agent is added to the molten active substance, suitably a mixture of rosin component and rosin ester component, with continuous agitation to form a water-in-oil emulsion. Then hot water is added with vigorous stirring until the emulsion inverts to an oil-in-water emulsion, which is cooled to form the rosin-based dispersion. The dispersion of rosin-based sizing agent can of course also be prepared by mixing a preformed dispersion of a rosin component with a preformed dispersion of a rosin ester component.

Aqueous dispersions or emulsions of cellulose-reactive sizing agents are known in the art and commercially available and such dispersions can be prepared in per se conventional manner, e.g., by mixing the cellulose-reactive sizing agent with an aqueous solution of a dispersing agent or emulsifier and passing the mixture through a homogenizer. Further methods for the preparation of aqueous dispersions of cellulose-reactive sizing agents as well as aqueous dispersions of rosin-based sizing agents will be appreciated by the person skilled in the art.

The dispersion according to the present invention can contain dispersed particles containing a mixture of rosin-based sizing agents and cellulose-reactive sizing agent. A method for preparing similar dispersions from rosin and a cellulose-reactive sizing agent is disclosed in U.S. Pat. No. 4,743,303, which is hereby incorporated by reference. The present dispersion can be prepared according to that method, subject to the modification that the rosin-based sizing agent contains a rosin ester component.

The present dispersion is particularly suitable for sizing of paper, paper board, board and similar cellulose fiber products containing precipitated calcium carbonate as a filler. The dispersion can be used for internal sizing and surface sizing, and is preferably used for internal sizing.

According to the present invention, the dispersion of sizing agents is suitably added to the stock, i.e., the aqueous suspension of pulp, in a conventional manner, and chemicals conventionally used at paper production, such as retention agents, aluminum compounds, wet-strength resins etc., can of course be used with the present dispersion. Examples of aluminum compounds include alum and polyaluminum compounds such as polyaluminum chlorides and sulphates. Paper chemicals such as retention agents can, if desired, also be incorporated in the actual dispersion. The dispersion is suitably used in an amount corresponding to 0.025 to 1% by weight of sizing agents, counted as dry on dry cellulose fibers.

The precipitated calcium carbonate is suitably added in a conventional manner to the aqueous pulp suspension. It can be added before, after or simultaneously with the addition of the dispersion of sizing agents.

The dispersion of sizing agents can be added to the stock at any point after refining is complete and prior to sheet formation. However, in order to achieve the objects of the present invention, it is not necessary to prepare the dispersion in advance, but this can be formed in situ. Thus, a preformed dispersion of the rosin-based sizing agent and a preformed dispersion of the cellulose-reactive sizing agent, or parts thereof, can be separately added to the stock at the same or at different points, followed by mixing of the dispersions with the stock before dewatering and drying of the stock. Separate additions of the preformed sizing dispersions may be advantageous when the cellulose-reactive sizing agent is an acid anhydride. Usually, acid anhydrides have low stability to hydrolysis, and dispersions or emulsions thereof are normally prepared on-site at the paper mill immediately prior to the addition to the stock. Thus, separate additions of the sizing agents may render operational benefits.

The invention is further illustrated in the following examples, which, however, are not intended to limit the same. Parts and % relate to parts by weight and % by weight, respectively, unless otherwise stated.

Example 1

An anionic dispersion of a rosin-based sizing agent containing 20% by weight of a rosin ester component, based on the rosin-based sizing agent, was prepared according to the following:

80 parts of tall oil rosin fortified with maleic anhydride was mixed at 150°–170° C. with 20 parts of a glycerol ester of rosin prepared from 12 parts of glycerol and 100 parts of rosin. The resulting mixture of fortified rosin and rosin ester was reacted with aqueous potassium hydroxide to neutralize about 5% of the available acidity and then cooled to 100°–103° C. with water. An aqueous anionic dispersion of casein was added rapidly to form a viscous oil-in-water emulsion. This was mixed intensively for 5 minutes and then diluted slowly with water at 80° C. and then with cold water more rapidly. Finally, a slimicide was added and the emulsion cooled rapidly to below 30° C. The final dispersion had an average particle size of less than 0.5 μm and a total solids content of 40%.

Example 2

An anionic dispersion of sizing agents according to the invention was prepared by mixing the anionic rosin-based sizing agent dispersion of Example 1 with a preformed anionic ketene dimer dispersion, Keydime A™, available from Eka Nobel Inc., USA, in amounts corresponding to a weight ratio of rosin-based sizing agent to cellulose-reactive sizing agent of 5:1. The content of rosin ester component was 20% by weight, based on the rosin-based sizing agent.

Example 3

The sizing performance of the aqueous dispersions of sizing agents according to the invention was evaluated and compared with reference AKD and rosin-based dispersions from which they had been prepared.

The anionic dispersions were used to prepare internally sized PCC-filled paper on a pilot paper machine. The paper was made from a 60:40 pulp blend of bleached hardwood and softwood kraft (lap pulp) beaten to 400 Canadian Standard Freeness and formed into sheets having a basis weight of 80 g/m$^2$ at a headbox pH of 7.6–8.2. The sheets were dried to 4.5–5.0% moisture at the reel.

Precipitated calcium carbonate was added in an amount of 12% by weight, counted as dry on dry cellulose fibers. The white water system was closed, with fresh water supplied only through the thick stock make down and showers. Each trial lasted for at least 12 to 15 minutes to allow the white water system to equilibriate.

Each dispersion was added to the thick stock just prior to dilution at the fan pump. The PCC was added to the fan pump inlet. Additions were further made of the following chemicals in specified amounts based on dry cellulose fibers: Polyaluminum chloride, Ekoflock™ available from Eka Nobel Inc., USA, 10 kg/ton added simultaneously with the dispersion and 0.5 kg/ton to tray (only to tray when the AKD dispersion was used). A retention and dewatering system, Compozil® available from Eka Nobel Inc., USA, comprising cationic starch and inorganic silica sol; 6 kg/ton cationic starch added to the thick stock just prior to dilution at the fan pump and 1 kg/ton silica sol added to the thin stock.

The PCC-filled sheets were tested using the Hercules Sizing Test (HST) with test solution No. 2 (1% formic acid) to 80% reflectance. Sheet samples were taken off the machine at the reel and after 1 week of natural ageing at room temperature and 50% relative humidity. The results are set forth in Table I below. Sizing level refers to the level of sizing agent in % by weight, based on dry cellulose fibers.

TABLE I

| Sizing | Sizing level (%) | | H S T (seconds) | |
|---|---|---|---|---|
| dispersion | AKD | Rosin-based | Off machine | 1 week ageing |
| Example 1 | — | 0.3 | 16 | 16 |
| Example 1 | — | 0.4 | 115 | 225 |
| Example 1 | — | 0.5 | 343 | 487 |
| AKD ref. | 0.08 | — | 1 | 1 |
| AKD ref. | 0.10 | — | 94 | 78 |
| AKD ref. | 0.13 | — | 218 | 228 |
| Example 2 | 0.05 | 0.25 | 80 | 310 |
| Example 2 | 0.065 | 0.33 | 580 | 810 |
| Example 2 | 0.085 | 0.42 | 620 | 820 |

As evident from the table, the dispersion of Example 2 according to the invention showed no signs of size reversion, but a marked improvement of the high initial sizing response was obtained after 1 week ageing. The sizing response achieved with the dispersion according to the invention was much higher than that achieved with the reference AKD and rosin-based dispersions from which it was prepared.

Example 4

The sizing performance of the aqueous dispersion of sizing agents according to the invention was evaluated in a manner similar to Example 3 but using 24% by weight of PCC, counted as dry on dry cellulose fibers. 15 kg/ton of Ekoflock™ was added with the dispersion of Example 2 that contained 0.6% sizing agents. All other additions were the same and the addition points were unchanged. The results are shown in Table II.

TABLE II

| Sizing | Sizing level (%) | | H S T (seconds) | |
|---|---|---|---|---|
| dispersion | AKD | Rosin-based | Off machine | 1 week ageing |
| Example 1 | — | 0.6 | 224 | 286 |
| AKD ref. | 0.10 | — | 47 | 29 |
| AKD ref. | 0.13 | — | 126 | 126 |
| AKD ref. | 0.18 | — | 123 | 108 |
| Example 2 | 0.065 | 0.33 | 158 | 222 |
| Example 2 | 0.085 | 0.42 | 200 | 470 |

TABLE II-continued

| Sizing | Sizing level (%) | | H S T (seconds) | |
|---|---|---|---|---|
| dispersion | AKD | Rosin-based | Off machine | 1 week ageing |
| Example 2 | 0.10 | 0.50 | 577 | 884 |

As evident the dispersion of Example 2 according to the invention resulted in improved sizing at all sizing levels. The sizing response obtained with the combined sizing components of the invention was higher than would be expected from either component alone.

Example 5

In this Example, aqueous anionic dispersions of sizing agents with varying ratios of rosin ester component to rosin component were prepared by mixing preformed anionic dispersions of rosin-based sizing agent with the same preformed anionic ketene dimer dispersion as used in Example 2. The resulting dispersions contained 0%, 20%, 50%, and 80% by weight of glycerol ester of rosin, based on the rosin-based sizing agent, and the weight ratio of rosin-based sizing agent to alkyl ketene dimer was 5:1.

The anionic dispersions of rosin-based sizing agent were prepared in a manner similar to Example 1, but using varying levels of glycerol ester of rosin to yield the desirable content of rosin ester. The dispersions had a particle size of about 0.5 μm (the 80% dispersion had a particle size of 0.87 μm) and a dry solids content of about 40% by weight.

Example 6

Aqueous cationic dispersions of sizing agents with varying ratios of rosin ester component to rosin component were prepared by mixing preformed cationic dispersions of rosin-based sizing agent with a preformed cationic ketene dimer dispersion, Keydime E™ available from Eka Nobel Inc , USA The dispersions contained 0%, 20%, 50%, and 80% by weight of glycerol ester of rosin, based on the rosin-based sizing agent, and the weight ratio of rosin-based sizing agent to alkyl ketene dimer was 5:1.

The cationic dispersions of rosin-based sizing agent were prepared by first dissolving the rosin-based sizing agent in an organic solvent, premixing the solution obtained with an aqueous solution of epichlorohydrin-polyamidoamine resin at 50° C. The crude dispersion was passed through an homogenizer until the resulting dispersion had a particle size of about 0.5–0.6 μm and the solvent was finally stripped off using a rotary evaporator. The obtained cationic dispersions of rosin-based sizing agent had a dry solids content of about 19% by weight and rosin-based sizing agent content of about 17% by weight.

Example 7

The sizing performance of the anionic dispersions of Examples 5 was evaluated by preparing laboratory handsheets. Paper sheets with a basis weight of 100 g/m$^2$ were prepared from the same pulp and using the same chemicals as used in Example 3.

The handsheets were pressed to achieve a 50% moisture content and dried at 80° C. for 4 minutes dwell period.

The chemicals were added to the thin stock at 0.5% consistency. The addition sequence and levels of the chemicals added, based on dry cellulose fibers, were as follows (thin stock at 0 seconds): 0.5% of cationic starch at 10 seconds, 2.0% (as received) of polyaluminum chloride at 20 seconds, 0.25% of anionic dispersion of sizing agents at 30 seconds, 10% of PCC at 40 seconds, 0.7% (as received) of silica sol at 50 seconds, and sheet formation at 75 seconds.

The sizing response was measured as in Example 3. Tests were performed on sheets after 24 hours natural ageing and after 1 week ageing at constant room temperature and 50% relative humidity. The test results are set forth in Table III below. Rosin ester (%) is the amount in % by weight of rosin ester component present in the rosin-based sizing agent.

TABLE III

| | H S T (seconds) | | |
|---|---|---|---|
| Rosin ester (%) | 24 h ageing | 1 week ageing | Difference (%) |
| 0 | 284 | 204 | −28 |
| 20 | 459 | 398 | −13 |
| 50 | 373 | 380 | +2 |
| 80 | 7 | 5 | −29 |

The Table clearly demonstrates the benefit of including a rosin ester component in the dispersion of combined sizing agents. The dispersions containing 20 and 50% by weight of the rosin ester component gave a higher initial size response, a higher size response at storage and less size reversion.

Example 8

The sizing performance of the aqueous cationic dispersions of Examples 6 was evaluated in a manner similar to Example 7. A comparison was also made with the cationic AKD dispersion from which they were prepared, which was added in an amount corresponding to 0.09 and 0.1% by weight of AKD, respectively, based on dry cellulose fibers. The cationic dispersion of combined sizing agents according to the invention was used in a level corresponding to 0.35% by weight of combined sizing agents, based on cellulose fibers. All other additions were the same and the addition points were unchanged. The results are set forth in Table IV below. R E (%) is rosin ester (%), as in Example 7.

TABLE IV

| Sizing | | H S T (seconds) | | |
|---|---|---|---|---|
| dispersion | R E (%) | 24 h ageing | 1 week ageing | Diff. (%) |
| AKD (0.09) | — | 142 | 80 | −44 |
| AKD (0.1) | — | 233 | 163 | −30 |
| Example 9 | 20 | 454 | 340 | −25 |
| Example 9 | 50 | 481 | 425 | −11 |
| Example 9 | 80 | 274 | 240 | −22 |

The dispersions according to the invention containing 20 and 50% by weight of the rosin ester component showed a high initial size response and a high size response at storage.

We claim:

1. A method of sizing cellulose fiber based products containing precipitated calcium carbonate as a filler which comprises dewatering and drying an aqueous suspension of cellulose fiber containing pulp in the presence of an aqueous dispersion of a rosin-based sizing agent which comprises a rosin component and from 5 to 75% by weight based on the rosin-based sizing agent of a rosin ester component, and an aqueous dispersion of a cellulose-reactive sizing agent, wherein the weight ratio of rosin-based sizing agent to cellulose-reactive sizing agent is from 1:1 to 20:1, and forming said pulp into the desired cellulose fiber based product.

2. The method of claim 1 wherein said cellulose fiber based products are selected from the group consisting of paper, paper board and board products.

3. The method of claim 1, wherein the rosin component is selected from the group consisting of rosin, disproportionated rosin, hydrogenated rosin, formaldehyde-treated rosin, fortified rosin, and mixtures thereof.

4. The method of claim 1, wherein the rosin ester component is a rosin ester of an alcohol selected from the group consisting of mono-, di- and polyhydric alcohols, and mixtures thereof.

5. The method of claim 1, wherein the cellulose-reactive sizing agent is a ketene dimer or acid anhydride, or a mixture thereof.

6. The method of claim 1, wherein the weight ratio of rosin-based sizing agent to cellulose-reactive sizing agent is from 3:1 to 10:1.

7. The method of claim 1, wherein the sizing agents are present in aqueous anionic dispersions.

8. The method of claim 1, wherein the sizing agents are present in aqueous cationic dispersions.

9. The method of claim 1, wherein the sizing agents are present in an aqueous dispersion containing dispersed particles which contains a mixture of the rosin-based sizing agent and cellulose-reactive sizing agent.

10. The method of claim 1, wherein the aqueous pulp suspension contains precipitated calcium carbonate in an amount of up to 35% by weight, based on dry cellulose fibers.

11. An aqueous dispersion of sizing agents which comprises a rosin-based sizing agent which comprises a rosin component and from 5 to 75 % by weight based on the rosin-based sizing agent of a rosin ester component, and a cellulose-reactive sizing agent, wherein the weight ratio of rosin-based sizing agent to cellulose-reactive sizing agent is from 1:1 to 20:1.

12. The dispersion of claim 11, wherein the rosin component is selected from the group consisting of rosin, disproportionated rosin, hydrogenated rosin, formaldehyde-treated rosin, fortified rosin, and mixtures thereof.

13. The dispersion of claim 11, wherein the rosin ester component is a rosin ester of an alcohol selected from the group consisting of mono-, di- and polyhydric alcohols, and mixtures thereof.

14. The dispersion of claim 11, wherein the cellulose-reactive sizing agent is a ketene dimer or acid anhydride, or a mixture thereof.

15. The dispersion of claim 11, wherein the weight ratio of rosin-based sizing agent to cellulose-reactive sizing agent is from 3:1 to 10:1.

16. The dispersion of claim 11, wherein the dispersion contains dispersed particles containing a mixture of the rosin-based sizing agent and cellulose-reactive sizing agent.

17. The dispersion of claim 11, which additionally comprises at least one anionic dispersing agent.

18. The dispersion of claim 16 which additionally comprises at least one anionic dispersing agent.

19. The dispersion of claim 11 which additionally comprises at least one cationic dispersing agent.

20. The dispersion of claim 16 which additionally comprises at least one cationic dispersing agent.

* * * * *